United States Patent [19]

Hirakura et al.

[11] 4,172,722

[45] Oct. 30, 1979

[54] ELECTROSTATIC COPYING METHOD FOR FORMING MULTIPLE COPIES

[75] Inventors: Koji Hirakura; Wasaburo Ohta; Tamio Ohhori; Masaaki Nomura, all of Tokyo, Japan

[73] Assignee: Ricoh Co., Ltd., Tokyo, Japan

[21] Appl. No.: 676,388

[22] Filed: Apr. 12, 1976

[30] Foreign Application Priority Data

Apr. 22, 1975 [JP] Japan ..... 50/49009

[51] Int. Cl.[2] ..... G03G 13/16; G03G 9/10; G03G 9/14

[52] U.S. Cl. ..... 96/1.4; 252/62.1 P; 101/DIG. 13; 96/1 SD

[58] Field of Search ..... 96/1 SD, 1.4; 252/62.1 P; 423/594; 101/DIG. 13

[56] References Cited

U.S. PATENT DOCUMENTS

| | | | |
|---|---|---|---|
| 2,846,333 | 8/1958 | Wilson | 252/62.1 |
| 3,627,682 | 12/1971 | Hall | 96/1 SD |
| 3,839,029 | 10/1974 | Berg et al. | 96/15 D |
| 3,944,493 | 3/1976 | Jadwin | 252/62.1 P |

OTHER PUBLICATIONS

L. G. van Vitert, J. Chem. Phys., 23, pp. 1883–1887, (1955).

E. E. Riches, "Ferrites," Mills & Boon Limited, London, (1972), Title Page and p. 22.

*Primary Examiner*—Roland E. Martin, Jr.
*Assistant Examiner*—John L. Goodrow
*Attorney, Agent, or Firm*—Blanchard, Flynn, Thiel, Boutell & Tanis

[57] ABSTRACT

This invention provides an electrostatic copying method for forming multiple copies by repeating the process of developing an electrostatic latent image formed on an electrophotographic insulating material with a dry developer comprising electroscopic powder and carrier particles and the process of transferring the thus developed image onto a transfer sheet continuously without erasing said latent image, said carrier particles consisting of an essentially homogeneous ferromagnetic oxide having an apparent electric conductivity in the range of $10^{-11}$–$10^{-5}\Omega^{-1}cm^{-1}$, thereby rendering it possible to form multiple copies compared with the conventional copying methods.

11 Claims, 3 Drawing Figures

ELECTROSTATIC COPYING METHOD FOR FORMING MULTIPLE COPIES

BACKGROUND OF THE INVENTION (a) Field of the Invention

The present invention relates to a method of forming multiple copies from one and the same electrostatic latent image, and particularly it relates to an improvement of the dry developer for use in said method.

(b) Description of the Prior Art

There have been known a variety of methods for forming multiple copies by repeating the process of developing an electrostatic latent image formed on the insulating surface of an electrophotographic insulating material such as an electrophotographic sensitive material which consists of a support and a photoconductive layer formed thereon, an electrostatic recording material which consists of a support and a dielectric layer formed thereon, etc. with a dry developer and the process of transferring the thus developed image onto a transfer sheet in succession without erasing said latent image (cf. Japanese Patent Publication Nos. 432/1967, 30233/1969 and 7789/1971, etc.). However, according to these known methods, there can be obtained no more than about 15–20 copies suitable for practical use. In other words, when the processes of developing and transferring are repeated, the portions of the image particularly the portions corresponding to letters and lines therein tend to become thin gradually and be erased in the end.

SUMMARY OF THE INVENTION

Figure 1:
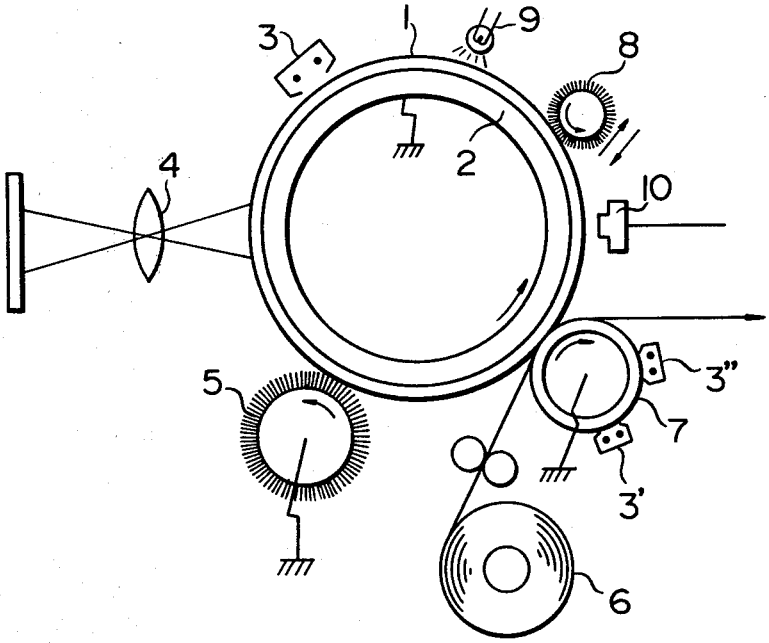
FIG. 1 is a schematic view of an apparatus for practicing the method of the present invention.

The present invention provides a method of minimizing the tendency of the image area to get thin as a result of repetition of the development-transfer process thereby to render it possible to obtain many more copies compared with the conventional methods.

In other words, the present invention is an improvement of the conventional methods of forming multiple copies, which is characterized by the employment of an essentially homogeneous ferromagnetic oxide having an apparent electric conductivity in the range of $10^{-11}$–$10^{-5}\,\Omega^{-1}\,cm^{-1}$ as carrier particles for the developer.

We have found that the phenomenon wherein the portions of the image area corresponding to letters and lines in particular become thin gradually with the repetition of the magnetic brush developing-transferring process is mainly ascribable to the iron powder constituting the carrier particles in the developer. That is, in the case of the carrier particles of this kind, compared with the high-insulating electroscopic powder, the electric charge of the latent image is apt to leak and this tendency is particularly remarkable in the portions of the latent image area corresponding to letters and lines wherein the electric charge is linearly distributed. On the contrary, in the portions of the latent image area corresponding to the so-called solid image area where the electric charge has been uniformly distributed so as to extend over a relatively wide area, the electroscopic powder adheres in large quantities and therefore there will not occur any conspicuous deterioration of the image quality ascribable to the leakage of the electric charge.

As the carrier for the developers for use in the magnetic brush developing process, a magnetic carrier having its surface subjected to insulating treatment for the purpose of minimizing the leakage or decay of electric charge in the latent image area has been known (cf. Japanese Patent Publication No. 17298/1974). However, this carrier involves such serious defects that (1) the insulating coated layer would be worn away when used for a long time, resulting in deterioration of the insulating property and (2) the dynamic conductivity of the carrier powder has not been taken into consideration at all.

Hereunder will be further elucidated the problem of dynamic conductivity under (2) above.

Generally speaking, when carrier particles come into contact with an image imparted with an electrostatic charge, a part of said electrostatic charge in proportion to the apparent conductivity of the carrier particles runs to the earth. In addition, there takes place a phenomenon that the surface of the carrier particle is imparted with a surface electric charge coupled with electric charge in an amount corresponding to the capacitance of the carrier particle. Besides, inasmuch as the carrier particles are moving convulsively, by the time the carrier particles come into contact with the electrostatic image, the electric charge imparted through contact with parts having earth potential will have been discharged. Consequently, in the course of the developing process there will take place leakage of the electric charge of the electrostatic image due to such charge and discharge on the part of the carrier particles. By the way, the amount of electric charge to be imparted depends on the capacitance of the carrier particle; in the case of the conventional carrier particle whose inner part consists of a conductive substance such as iron and whose surface is coated with a thin layer of resin, the capacitance is very great and the amount of electric charge to be imparted is large, resulting in much leakage of the electric charge of the electrostatic image. In the initial developing process, the damage of the image may not be very conspicuous, but with the repetition of the process, the concentration of electrostatic image comes to be strikingly deteriorated.

On the contrary, in the case of the carrier particles employed in the method of the present invention, which consist of an essentially homogeneous ferromagnetic oxide having an apparent electric conductivity in the range of $10^{-11}$–$10^{-5}\,\Omega^{-1}\,cm^{-1}$, the capacitance thereof is so small that the leakage of electric charge of the electrostatic image is little and therefore it is possible to form such a great number of copies as cannot be expected of the conventional carrier particles, from one and the same electrostatic latent image. For example, in the case of a zinc oxide resin dispersion type electrophotographic sensitive material or an organic photoconductor type electrophotographic sensitive material comprising poly-N-vinyl carbazole as the main constituent thereof, an electrostatic latent image formed thereon can produce more than 100 copies continuously.

The ferromagnetic oxide for use in the developer of the present invention, which ranges over good conductors and insulators of electricity according to the chemical composition thereof, can be relatively easily obtained as in well known.

We have selected ferromagnetic oxides belonging to the category generally called insulators, which brought on satisfactory results. To cite suitable ferromagnetic oxides, there are $M^1Fe_2O_4$ (wherein $M^1$ represents such metals as Mn, Fe, Co, Ni, Cu, Zn, Mg and Cd), $M^2Fe_{12}O_{19}$ (wherein $M^2$ represents Ba, Sr, Pb, etc.), $M^3FeO_3$ (wherein $M^3$ represents rare earth elements), $M_3{}^4Fe_5O_{12}$ (wherein $M^4$ represents rare earth elements), etc. And, in addition to these, there can be cited $CrO_2$, $M^5MnO_3$ (wherein $M^5$ represents Ni, Co, La, Ca, etc.) and the like. The above cited ferromagnetic oxides may be used either individually or as a mixture or a solid solution consisting of two oxides or more of either the same kind or different kinds. In this context, among these ferromagnetic oxides, the oxide expressed by $MFe_2O_4$ is ferrite which has hitherto been used as the carrier for developer.

All of the foregoing ferromagnetic oxides for use in the present invention are stable oxides free of change with the lapse of time on the occasion of practical use and are relatively inexpensive. Besides, these ferromagnetic oxides can be used as the carrier for the cascade developing process, not to speak of the magnetic brush developing process.

Figure 3:
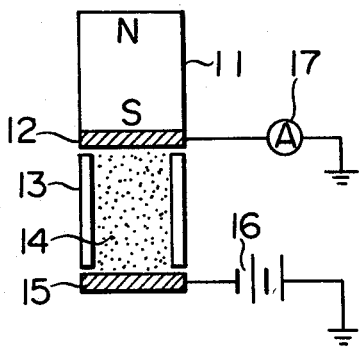
FIG. 3 is a schematic illustration of an apparatus for measuring the apparent electric conductivity of carrier particles.

The ferromagnetic oxide for use in the present invention is generally prepared by subjecting the material to pressure sintering thereby to turn it into lumps and then crushing and pulverizing said lumps. The appropriate particle diameter is usually in the range of 20–200 μm, and preferably in the range of 50–100 μm from the view point of the stability of triboelectric properties; in the case where the particle is too coarse, its tendency to scrape off toner particles adhering to the latent image area will increase, while in the case where it is too fine, not only the triboelectric properties between it and the toner particle and the electrification become unstable but also it is apt to adhere to the surface holding the latent image. As to the apparent electric conductivity of the particle, a satisfactory effect can be expected when it is in the range of $10^{-11}$–$10^{-5}$ $\Omega^{-1}$ $cm^{-1}$ or thereabouts. In this connection, it is very difficult to exactly specify the intrinsic electric conductivity of powder, and in fact, it has not much significance to do so. Because, on the occasion of practical use thereof as the carrier, the ferromagnetic oxide is employed in the form of powder, and therefore, the effect of pulverization and the effect of adsorption of gas particularly water onto the surface of powder have a great influence thereon. Accordingly, the electric conductivity of the carrier powder in the present invention is required to be specified in terms of apparent value not in terms of intrinsic value thereof. This apparent electric conductivity means a value obtained by making a magnet attract the carrier thereby to form a magnetic brush, applying voltage between the tip of this brush and the magnet and dividing the amount of electric current running through unit volume of the magnetic brush by the applied voltage. This apparent electric conductivity is measured by means of such an apparatus as shown in FIG. 3 of the appended drawings. In FIG. 3, the reference numeral 11 denotes the magnet, 12 and 15 denote the electrodes, 13 denotes the insulating cell measuring $1\times1\times1$ $cm^3$, 14 denotes the magnetic carrier powder formed into a magnetic brush, 16 denotes the power source, and 17 denotes the electrometer.

In the developer of the present invention, in addition to the ferromagnetic oxides, any of the resin powders popular as electroscopic powders for use in the conventional dry developers, such as Landrigan U.S. Pat. No. 2,753,308, can be employed.

Hereunder will be explained the method in the present invention by reference to FIG. 1. In FIG. 1, the reference numeral 1 denotes the photoconductive layer to be represented by amorphous selenium or zinc oxide resin dispersion layer, which is coated on the support 2 consisting of a metal cylinder. 3 denotes the corona charger, which is supposed to effect uniform corona charging on the surface of the photoconductive layer 1. 4 denotes the exposing station where a pattern of electrostatic latent image is to be formed according to the pattern of the image-to-be-copied. 5 denotes the developing station; the present drawing is illustrative of the developing station in the case of the magnetic brush developing process, and in this station a pattern of toner particle image is formed on the surface of the photoconductive layer 1 according to the electrostatic latent image. 7 denotes the roller for the purpose of transferring the toner particle image, the inside of said roller consisting of a conductive material while the surface thereof being covered with a dielectric layer. The surface of this roller is charged by means of the corona charger 3' so as to have a polarity opposite to the electric charge of the toner for the purpose of transferring the toner image. Another corona charger 3'' is the charge-erasing charger for the purpose of regulating the surface potential of the roller 7. 6 denotes the transfer paper, onto which the toner particle image is to be transferred from the photosensitive layer surface 1 through pressure contact by means of the transfer roller 7. 8 denotes the cleaning brush for the purpose of removing the residual toner particles when the multiple transfer is over. 9 denotes the lamp for the purpose of erasing the residual electric charge of the photosensitive layer when the multiple transfer is over. And, 10 denotes the head of the electrometer for the purpose of measuring the surface potential of the photosensitive surface after transferring the toner image.

The process of forming multiple copies is performed through the following procedure. To begin with, a light image is exposed at the exposing station 4 onto the photoconductive layer uniformly charged by means of the corona charger 3, whereby an electrostatic charge pattern according to the light image is formed. As the process of forming multiple copies is for the purpose of obtaining multiple copies from one and the same latent image by repeating the processes of developing and transferring this electrostatic charge pattern, after said latent image has been formed, the cleaning brush 8 separates from the photoconductive layer surface, the charge-erasing lamp 9 goes out, and the power source of the corona charger 3 is also cut. Exposure of the light image is of course discontinued. When the copying of a required number of copies is over, the cleaning brush 8 comes in contact with the photoconductive layer surface and rotates thereby to remove the residual toner, and further said photoconductive layer is exposed to irradiation of the lamp 9 thereby to erase the residual electric charge.

We have also compared the performances of various carriers for developers by employing the foregoing apparatus for producing multiple copies. With the repetition of the process of forming multiple copies, the electrostatic latent image formed on the photoconductive layer gradually decays. This decay is ascribable to the natural dark-decay inherent in the substances constituting the photoconductive layer, coupled with the decay arising from the contact between said substances and the transfer paper, and so forth. The most conspicuous decay takes place in the process of development; this can be verified mostly by measuring the electric current running between the magnetic brush of the developing apparatus and the metal support of the photoconductive layer, but it can be detected also by comparing the surface potential of the photoconductive layer before and after the leakage. In the present test of performances of carriers, the latter procedure was applied.

Particulars of the present invention will be explained hereunder with reference to some examples embodying it. Samples used in the examples were prepared as follows. That is, barium ferrite consisting mainly of $BaO.6Fe_2O_3$ was subjected to pressure sintering thereby to obtain hard ferrite lumps. The thus obtained ferrite lumps were crushed by means of a stamp mill, and further pulverized into ferrite powder having a mean particle diameter in the range of 150–70 μm. This powder manifested an apparent electric conductivity of about $10^{-11}\,\Omega^{-1}\,cm^{-1}$ in a dry atmosphere on the occasion of serving as the carrier for the magnetic brush developing process. This powder is hereinafter called F-carrier.

DESCRIPTION OF THE PREFERRED EMBODIMENTS

Example 1

Figure 2:
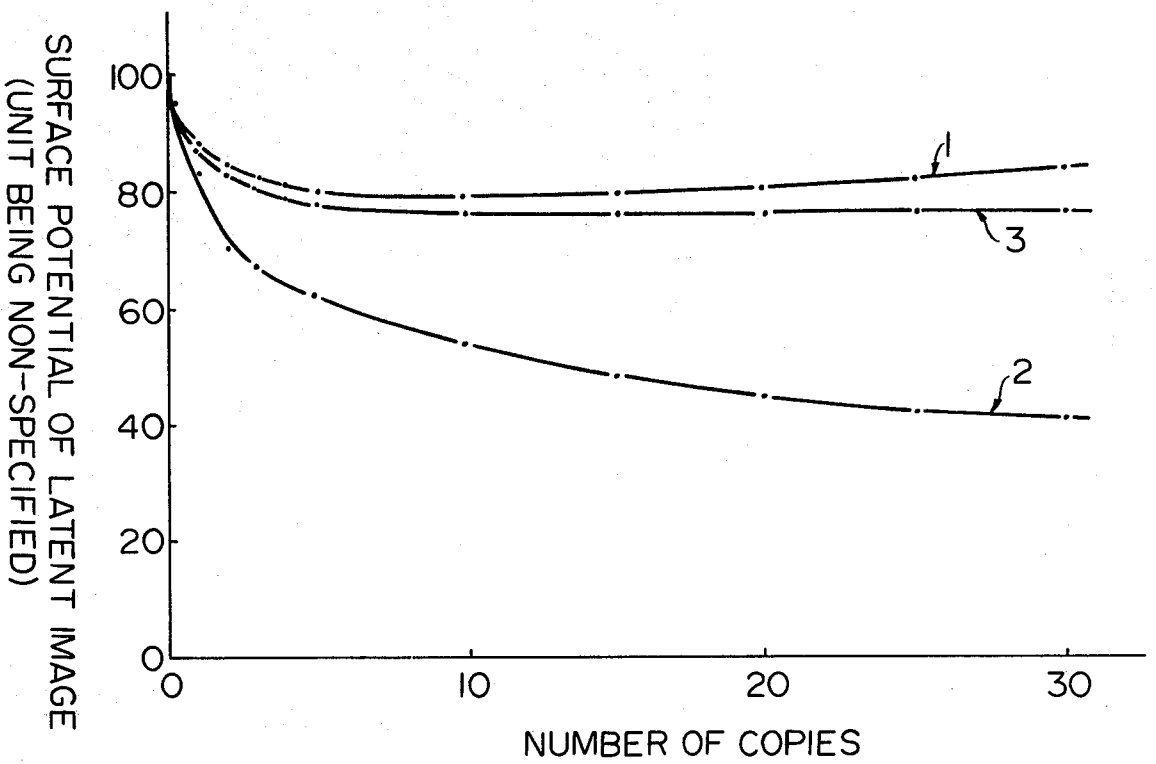
FIG. 2 is a graph illustrating the relationship between the number of copies obtained and the surface potential of the electrostatic latent image.

By coating an organic photoconductive substance consisting of poly-N-vinyl carbazole and trinitrofluorenone complex on an aluminum drum, a photoconductive layer of about 10 μm in thickness was formed. Next, this photoconductive layer was uniformly charged with negative polarity by means of a corona charger. The surface potential of the photoconductive layer on this occasion was −600 V. Subsequently, by exposing a light image of checkered pattern on the photoconductive layer, an electrostatic latent image corresponding to said light image was formed. By employing the thus formed electrostatic latent image and a dry developer consisting of 95 parts (parts by weight; the same will apply hereinafter) of F-carrier and 5 parts of a dry electroscopic powder, a toner image was formed on the photoconductive layer through the magnetic brush developing process. This toner image was transferred onto a plain paper by means of a transfer roller provided with a 120 μ-thick polytetrofluoroethylene coating as uniformly charged with −1,200 V, and the surface potential of the photoconductive layer subsequent thereto was measured. The relationship between the number of copies obtained through repetition of the foregoing procedure and the surface potential was as expressed by the curve-1 in FIG. 2. Meanwhile, the relationship between the number of copies obtained through the same procedure as above excepting that the dry developer was replaced with a developer employing a carrier consisting of iron powder coated with $Fe_3O_4$ (a commercial carrier) and the surface potential was shown by the curve-2 in FIG. 2 for the purpose of comparison. As will be understood from the comparison of the curve-1 with the curve-2, the developer employing F-carrier according to the present invention could drastically prevent the decay of electrostatic latent image compared with a conventional developer employing a carrier subjected to superficial insulating treatment. Further, in the case of the developer of the present invention, there could be obtained about 100 copies which showed little lowering of image density from one and the same latent image, while in the case of the conventional developer, there could be obtained no more than about 3 copies.

Example 2

When the same electrostatic latent image as in Example 1 was employed in obtaining multiple copies through the same procedure as in Example 1 excepting that a blended carrier consisting of 75–25 parts of F-carrier and 25–75 parts of the comparative carrier was applied instead of applying F-carrier alone as in Example 1, there were obtained more than 60 copies having a higher image density than that of the copies in Example 1. In this connection, the decay of the electric charge of the electrostatic latent image in the present example was almost the same as that in the case of the developer employed in Example 1 according to the present invention, as illustrated by the curve-3 in FIG. 2.

Example 3

When the same electrostatic latent image as in Example 1 was employed in obtaining multiple copies through the same procedure as in Example 1 excepting that a blended carrier consisting of 70–20 parts of F-carrier and 30–80 parts of the well-known carrier prepared by coating resin on iron powder was applied instead of applying F-carrier along as in Example 1, there was obtained practically the same result as in Example 2.

As is evident from the above examples, in the present invention, not only a ferromagnetic oxide having a relatively high resistance is applicable as simple substance, but also even a mixture consisting of this ferromagnetic oxide of high resistance and a well-known resin-coated carrier or a ferromagnetic oxide of relatively low resistance (such as iron powder, ferrite, etc.) can be applied providing that the content of the former is more than 20% by weight.

What is claimed is:

1. A method for preparing multiple developed copies from a single electrostatic latent image which comprises forming an electrostatic latent image on a surface, contacting said latent image with a dry developer consisting essentially of a mixture of electroscopic powder and carrier particles whereby to attract and hold said electroscopic powder on said surface to form a developed image on said surface corresponding to said latent image, said electroscopic powder consisting essentially of a resin powder capable of being triboelectrically charged by contact with said carrier particles, said carrier particles consisting essentially of a substantially homogeneous ferromagnetic oxide having an apparent electric conductivity in the range of from $10^{-11}$ to $10^{-5}\,\Omega^{-1}\,cm^{-1}$, transferring said dry developer that defines said latent image from said surface onto a transfer sheet whereby to form said developed image on said transfer sheet, and repeating said contacting and transferring steps without erasing said latent image whereby to obtain multiple copies of said latent image.

2. A method according to claim 1, wherein said ferromagnetic oxide is at least one substance selected from the group consisting of compounds having the formula $M^1Fe_2O_4$ wherein $M^1$ is a member selected from the group consisting of Mn, Fe, Co, Ni, Cu, Zn, Mg and Cd, compounds having the formula $M^2Fe_{12}O_{19}$ wherein $M^2$ is a member selected from the group consisting of Ba, Sr and Pb, compounds having the formula $M^3FeO_3$ wherein $M^3$ is a rare earth element, compounds having the formula $(M^4)_3Fe_{25}O_{12}$ wherein $M^4$ is a rare earth element, $CrO_2$, compounds having the formula $M^5MnO_3$ wherein $M^5$ is a member selected from the group consisting of Ni, Co, La and Ca, mixtures of said substances and solid solutions thereof.

3. A method according to claim 1, wherein the particle diameter of said ferromagnetic oxide is in the range of from 20 to 200 $\mu$m.

4. A method according to claim 3, wherein the particle diameter of said ferromagnetic oxide is in the range of from 50 to 100 $\mu$m.

5. A method according to claim 1 wherein said carrier particles consist of $M^1Fe_2O_4$.

6. A method according to claim 1 wherein said carrier particles consist of $M^2Fe_{12}O_{19}$.

7. A method according to claim 1 wherein said carrier particles consist of $BaFe_{12}O_{19}$.

8. A method according to claim 1 wherein said carrier particles consist of $M^3FeO_3$.

9. A method according to claim 1 wherein said carrier particles consist of $(M^4)_3Fe_{25}O_{12}$.

10. A method according to claim 1 wherein said carrier particles consist of $CrO_2$.

11. A method according to claim 9 wherein said carrier particles consist of $M^5MnO_3$.

* * * * *